US008001731B2

(12) United States Patent
Huxel

(10) Patent No.: US 8,001,731 B2
(45) Date of Patent: Aug. 23, 2011

(54) SELF-SUPORTING SPATIAL UNIT HAVING NON-SUPPORTING ADVANCED OUTER WALLS

(76) Inventor: Rainer Huxel, Sinsheim (DE)

( * ) Notice: Subject to any disclaimer, the term of this patent is extended or adjusted under 35 U.S.C. 154(b) by 0 days.

(21) Appl. No.: 11/848,387

(22) Filed: Aug. 31, 2007

(65) Prior Publication Data

US 2008/0066422 A1 Mar. 20, 2008

Related U.S. Application Data

(63) Continuation of application No. PCT/EP2006/001809, filed on Feb. 28, 2006.

(30) Foreign Application Priority Data

Mar. 4, 2005 (DE) ..... 10 2005 009 978

(51) Int. Cl.
*E04B 2/00* (2006.01)

(52) U.S. Cl. ..... 52/79.9; 52/282.3; 52/309.8; 52/284; 52/275

(58) Field of Classification Search ..... 52/79.1–79.14, 52/282.3, 309.8, 284, 275–279
See application file for complete search history.

(56) References Cited

U.S. PATENT DOCUMENTS

| | | | | | |
|---|---|---|---|---|---|
| 3,175,940 | A * | 3/1965 | Talmey | 52/284 |
| 3,564,786 | A * | 2/1971 | Baker | 52/79.13 |
| 3,712,007 | A * | 1/1973 | Kump | 52/79.12 |
| 3,832,811 | A * | 9/1974 | Briel, Jr. | 52/79.13 |
| 3,885,367 | A * | 5/1975 | Thunberg | 52/282.3 |
| 3,921,355 | A * | 11/1975 | Pennecot | 52/284 |
| 3,999,355 | A * | 12/1976 | Stucky | 52/79.13 |
| 4,374,687 | A * | 2/1983 | Yamamoto | 52/309.8 |
| 4,443,992 | A * | 4/1984 | Shechter | 52/79.1 |
| 4,545,158 | A * | 10/1985 | Rizk | 52/79.1 |
| 4,854,094 | A * | 8/1989 | Clark | 52/79.1 |
| 4,974,386 | A * | 12/1990 | Eriksson et al. | 52/282.3 |
| 5,848,500 | A * | 12/1998 | Kirk | 52/79.1 |
| 6,298,619 | B1 * | 10/2001 | Davie | 52/284 |
| 6,421,972 | B1 * | 7/2002 | Dalphond et al. | 52/284 |
| 7,797,897 | B2 * | 9/2010 | Roth | 52/282.3 |

FOREIGN PATENT DOCUMENTS

| | | |
|---|---|---|
| DE | 26 24 632 A1 | 12/1977 |
| DE | 29 20 421 A1 | 12/1979 |
| DE | 37 11 215 A1 | 10/1987 |
| DE | 40 03 961 A1 | 8/1991 |

(Continued)

*Primary Examiner* — Robert J Canfield
*Assistant Examiner* — Matthew J Smith
(74) *Attorney, Agent, or Firm* — Laurence A. Greenberg; Werner H. Stemer; Ralph E. Locher

(57) ABSTRACT

A self-supporting module contains first and second rectangular, generally closed longitudinal frames, which are detachably interconnected by crossmembers and to which external wall elements are detachably fixed. The module is characterized in that the external wall elements have dimensions corresponding generally to the height and the width or length of the module and that the outer edges of the elements run flush with the outer edges of the longitudinal frames and crossmembers in such a way that in the corner region of the module, the end faces of adjoining external wall elements define a recess in the form of re-entrant corner. Corner elements are detachably fixed in the recesses, the elements sealing the interior of the module that is delimited by the external wall elements in relation to the exterior.

33 Claims, 9 Drawing Sheets

FOREIGN PATENT DOCUMENTS

| | | | |
|---|---|---|---|
| DE | 93 12 109 1 | | 11/1993 |
| DE | 19854401 | A1 | 6/2000 |
| EP | 1 308 569 | A2 | 5/2003 |
| FR | 2 516 568 | | 5/1983 |

* cited by examiner

SELF-SUPORTING SPATIAL UNIT HAVING NON-SUPPORTING ADVANCED OUTER WALLS

CROSS-REFERENCE TO RELATED APPLICATIONS

This is a continuation, under 35 U.S.C. §120, of copending international application No. PCT/EP2006/001809, filed Feb. 28, 2006, which designated the United States; this application also claims the priority, under 35 U.S.C. §119, of German patent application No. DE 10 2005 009 978.5, filed Mar. 4, 2005; the prior applications are herewith incorporated by reference in their entirety.

BACKGROUND OF THE INVENTION

Field of the Invention

The invention relates to a self-supporting spatial unit having non-supporting outer wall elements which are placed on the outer sides of the spatial unit. The self-supporting spatial unit has first and second rectangular, substantially closed longitudinal frames which are connected releasably to one another via crossmembers, to which the outer wall elements are fastened releasably.

On account of the rising prices for residential and commercial buildings, in particular for privately owned homes, as a consequence of higher requirements on thermal insulation and high costs for operating a construction site, building construction systems have been developed, in which a building can be constructed in a simple and inexpensive manner with prefabricated spatial units.

For instance, German Utility Model DE 93 12 109 U1 discloses a building construction which contains prefabricated spatial units and in which the spatial units contain a steel skeleton having a rectangular base frame, a rectangular ceiling frame and four vertical supports which connect the frames. In order to form a living space, in the case of spatial units which are disposed above one another or next to one another, their outer faces are enclosed by thermally insulating and soundproof multiple-part outer wall elements in a lightweight construction. The lowermost outer wall element being supported on supporting strips which are disposed on the base frame. In order to form a floor or a ceiling, guides are provided in the base and ceiling frames, into which guides individual plate elements made from concrete can be inserted. Here, the frame construction which is formed from the spatial units is supported on the subsoil via strip foundations, the base frame resting directly on the foundations.

A further spatial unit which is formed from a self-supporting steel skeleton is described in published, non-prosecuted German patent application DE 40 03 961 A1, the steel skeleton containing an upper frame and a lower frame and supports which are situated between the former. Here, the ceiling and the base tub are mounted on profiles, in particular Z profiles, which are disposed horizontally in the upper and lower frames.

Furthermore, published, non-prosecuted German patent application DE 198 54 401 A1 discloses construction frames which can be stacked, are made from steel and have an upper and a lower frame, vertical carriers which transfer the loads from the upper to the lower frame being distributed over the longitudinal and transverse sides of the upper and lower frames. Here, the walls are formed by lining elements which are attached to the vertical carriers, the outer walls being provided additionally with an insulating element. In order to form window and door apertures, the vertical carriers are delimited, furthermore, by additional horizontally extending intermediate carriers.

Furthermore, published, non-prosecuted German patent application DE 29 20 421 A1 describes a construction frame having outer walls which are attached to the frame and in which a floor plate and a ceiling plate are connected to one another via shelved vertical supports and form a spatial unit.

On account of the complicated construction of the spatial units which are known from the prior art with a high number of different components, the building constructions which are formed from the spatial units can be constructed only with high technical expenditure and can be adapted only with difficulty to the changing requirements of the constructor. Furthermore, the spatial units have thermal bridges, in particular in the region of the connection of the outer wall elements, which thermal bridges necessitate a high heating warmth requirement in the building constructions which are constructed from the spatial units.

SUMMARY OF THE INVENTION

It is accordingly an object of the invention to provide a self-supporting spatial unit having non-supporting advanced outer walls which overcomes the above-mentioned disadvantages of the prior art devices of this general type, which can be used flexibly and can be constructed with low technical expenditure, and which also satisfies high requirements with respect to thermal insulation.

With the foregoing and other objects in view there is provided, in accordance with the invention a self-supporting spatial unit. The spatial unit contains crossmembers having outer edges, first and second rectangular, substantially closed longitudinal frames connected releasably to one another via the crossmembers and has outer edges, and outer wall elements having outer edges and fastened releasably to the first and second longitudinal frames. The outer wall elements are substantially of a size corresponding to a height, a width or length of the spatial unit and terminate flushly at the outer edges with the outer edges of the longitudinal frames and of the crossmembers such that end sides of adjacent ones of the outer wall elements define recesses each in a form of a bent-in corner in a corner region of the spatial unit. Corner elements are fastened releasably in the recesses, the corner elements seal with respect to an outside an interior of the spatial unit delimited by the outer wall elements.

According to the invention, the self-supporting spatial unit contains the first and second rectangular, substantially closed longitudinal frames. The first and second longitudinal frames are connected releasably to one another via crossmembers. Here, the three-dimensional frame construction which is formed by the crossmembers and longitudinal frames advantageously has only a low weight. Outer wall elements, floor terminating elements and roof elements which are placed releasably on the outer upper, lower, longitudinal and/or broad sides of the spatial unit terminate flushly with the outer edges of the spatial unit which is formed from longitudinal frames and crossmembers, the outer wall elements, floor terminating elements and roof elements being of a size which corresponds substantially to the height, the width or the length of the spatial unit. In the following text, for the sake of simplicity, the floor terminating element which is disposed on the lower side of the spatial unit and the roof element which is disposed on the upper side of the spatial unit will largely likewise be denoted as an outer wall element.

The end sides of the adjacent outer wall elements form a recess in the corner region of a spatial unit, which recess has the form of a bent-in corner having a preferably rectangular cross section. In order to seal the interior which is delimited by the outer wall elements with respect to the outer sides of the spatial unit, corner elements are fastened releasably in the recesses.

On account of the releasable fastening of the crossmembers to the longitudinal frames, of the outer wall elements to the outer sides of the spatial unit and of the corner element in the recess, the spatial unit can be dismantled completely into its individual parts, it being possible for the individual components to be exchanged, reused or recycled in an inexpensive and environmentally friendly manner after dismantling.

The outer wall elements are, in particular, light, self-supporting, non-reinforcing and thermally insulated components which serve only to protect the space which is enclosed by the outer wall elements against weather influences, but do not assume a static function. As the spatial unit which is formed from the longitudinal frames and crossmembers automatically assumes the function of statics and reinforcement and the outer wall elements are placed releasably on the outer side of the spatial unit, the construction of the outer wall elements and the corner elements can be kept simple, as a result of which they can be manufactured inexpensively industrially in mass production.

Here, it is possible, for example, that the outer wall elements have a carrying frame made from wood, into which thermally insulating elements, window and door surfaces can be integrated. Fastening points are required only for fastening the outer wall elements releasably to the spatial unit, it being possible, however, for these to be realized, for example, via screw or plug-in connections in a simple manner. The corner elements are preferably provided with thermal insulation and, like the outer wall elements, mainly serve to protect against weather influences. Here, that section of the corner element which extends from outer side to outer side of the outer wall elements can have a rectangular, circular, oval, arcuate and/or polygonal cross section, the cross section of the corner element preferably corresponding to the shape of the recess for accurate insertion of the corner element into the recess. It is therefore possible in this context, for example, in the case of a bent-in corner in the corner region of the spatial unit that the corner element has a polygonal cross section having a circular section and two limb faces which are disposed at a right angle with respect to one another, in each case one limb face of the corner element facing in each case one end face of an outer wall element. Furthermore, in the region of the roof, there can be provision, in particular, for the corner element to have a rainwater gutter in the section which extends from the outer wall element to the roof element.

Furthermore, for the individual coloring of the spatial unit, there can be provision for the outer wall elements and corner elements to be available in a range of different colors. For example, it is therefore conceivable that the outer wall elements and corner elements are offered in different styles, such as a country house style or a Bauhaus style, the outer wall elements and corner elements preferably having the same construction and differing only in terms of color and design decor elements.

According to the invention, the spatial unit has a length which is twice as great as the width of the spatial unit. This results in the advantage that, during construction of a building construction, the spatial units can be disposed both with adjacent longitudinal edges parallel to one another and with adjacent longitudinal and broad sides perpendicular or transverse with respect to one another. Here, the outer sides of two spatial units which are oriented with adjacent longitudinal sides parallel to one another and a third spatial unit which is disposed at a right angle with respect to this on the broad sides or end sides of the two spatial units which lie parallel to one another form the shape of a rectangle in plan view. In this way, a large number of possible combinations of the spatial units affords a large number of possible designs for a building which is formed from spatial units. For the further individual design of buildings, however, the spatial units can also have dimensions which deviate from this. It is thus possible, for example, that individual spatial units are only half as long and/or wide as other spatial units.

In a manner according to the invention, the spatial units have a height and width of less than 350 cm, and a length of less than 650 cm, a length of 530 cm and a width of 265 cm having proved particularly advantageous for transport, in particular on trucks. As a result, the spatial unit can be manufactured industrially at a manufacturing location with low costs and can be transported inexpensively to the respective construction site, in particular by truck, after manufacture on account of the low weight of the spatial unit. The outer wall elements which are to be attached can have, for example, a thickness of approximately 30 cm in this case.

Furthermore, the dimensions according to the invention of the spatial unit and the associated transportability results in the advantage that the spatial unit and the outer wall elements and corner elements which are attached to it are not assigned fixedly to one construction plot. It is thus conceivable, for example, that, if the constructor moves to a different location, the spatial unit can be dismantled and taken along together with the outer wall elements and corner elements, and including the readymade foundations, in order to be constructed again at a different location.

In order to obtain a self-supporting spatial unit without reinforcing elements, the crossmembers are connected according to the invention in a flexurally rigid manner to the longitudinal frames via an end plate connection. Here, depending on the embodiment and size of the spatial unit, end plates can be provided both on the longitudinal frames and on the crossmembers. Here, the crossmembers are preferably connected to the longitudinal frames via a screw connection, with the result that the spatial unit can advantageously be dismantled for transport with, in particular, relatively small transport vehicles, and can be extended for a redesign. Here, the end plate connection is configured structurally in such a way that the maximum bending moments and transverse forces, such as occur, for example, in a multistory arrangement of the spatial units above one another, can be transmitted from the crossmembers to the longitudinal frames. In addition, in one advantageous embodiment of the invention, the longitudinal frames have reinforced corners, with the result that no further shelving or reinforcing elements are required for the statics of the longitudinal frame.

In a difference from known shoring, factory halls or residential buildings of modular construction, the construction of buildings from the self-supporting spatial units according to the invention results in the advantage that they can be realized easily according to the kit principle. For example, the outer wall elements and corner elements of a spatial unit can be added to, replaced or changed in a modular manner in the manner of a kit, without taking consideration of the statics.

According to the invention, the longitudinal frame includes a first lower and a second upper longitudinal carrier which are connected in a flexurally rigid manner to one another via a first and second support which have a preferably square hollow profile and are disposed in the end region of the longitudinal carriers. Here, for example, the connection of the first and the second supports to the longitudinal carriers can be effected releasably via a screw connection or else fixedly via a welded connection, an end plate connection preferably being provided between the longitudinal carrier and the support for transmitting the bending moments and the transverse forces. Here, the supports preferably have a length which corresponds to the height of the spatial unit, with the result that the longitudinal carriers are connected to the supports over their end sides. However, the supports can also be shorter, the longitudinal carriers have a length which corresponds to the length of the spatial unit.

In one further advantageous embodiment of the invention, there can be provision, for example, for the longitudinal frames to have two supports of different lengths in order to form a spatial unit having an inclined roof surface. Here, according to the invention, the longitudinal frames are connected to one another via crossmembers and have upper longitudinal carriers which are inclined at an angle with respect to the horizontal. For a relatively great inclination angle of the roof surface, it is also possible as an alternative to this to connect two longitudinal frames of different heights to one another via crossmembers. Here, the outer wall element rests as a roof surface on the longer upper longitudinal carriers and the shorter upper crossmembers which extend at an angle with respect to the horizontal.

According to the invention, in order to support the self-supporting outer wall elements which are disposed on the longitudinal and broad sides of the spatial unit, at least one supporting strip is disposed on the lower longitudinal carriers and/or on the lower crossmembers, onto which supporting strip the outer wall element is placed releasably.

Here, according to the invention, the supporting strip has the shape of an elbow, the outer wall element being supported on one limb and it being possible for the other limb of the elbow to be screwed and welded to the lower longitudinal carrier, or the other limb being connected on the lower longitudinal carrier. Furthermore, depending on the weight of the outer wall element, the supporting strip can be composed either of a metal sheet or of a plastic material, a plastic material being advantageous for avoiding thermal bridges, on account of the relatively low coefficient of thermal conductivity.

Instead of a supporting strip, however, lugs or recesses can be provided on the lower longitudinal carriers and/or the lower crossmembers, into which lugs or recesses hooks or journals engage which are disposed for this purpose in the lower region of the outer wall elements.

According to the invention, the outer wall element is connected to the upper longitudinal carrier via a connecting device, in particular a screw connection, it also being possible, however, for the outer wall element to be connected on the upper longitudinal carrier. This results in the advantage that the outer wall element can be mounted and also dismantled simply. During mounting, the outer wall element is placed here, for example, first on a supporting strip which is disposed on the lower longitudinal carrier and/or crossmember or is connected in the lugs or recesses which are disposed on the lower longitudinal carrier and/or crossmember, in order then to be screwed against the upper longitudinal carrier.

The first lower longitudinal carrier has an open, preferably U-shaped cross section in a further embodiment according to the invention, the opening of the cross-sectional shape preferably being directed into the interior of the spatial unit. During the manufacture of the longitudinal frames and the spatial units, the upper longitudinal carriers and crossmembers preferably have the same profile shape as the lower longitudinal carriers and crossmembers, as a result of which only a minimum number of different profile cross sections are to be kept in the store, in an advantageous manner for manufacturing.

The selection of an open cross section for the longitudinal carriers and/or crossmembers advantageously affords the possibility of inserting a prefabricated floor element into the first lower longitudinal carrier and/or a prefabricated ceiling element into the second upper longitudinal carrier, which results in a time advantage during completion of a spatial unit. During the assembly of a spatial unit from longitudinal frames with longitudinal carriers which extend over the length of the spatial unit, it is possible, for example, before assembly of the last lower crossmember to insert the floor element via the broad side of the crossmember which has not yet been assembled, the open cross sections of the lower longitudinal carriers serving as guide. Here, according to the invention, the floor element is self-supporting and substantially flexurally rigid, with the result that advantageously no additional reinforcing elements are required in the region of the floor. A further advantage of this embodiment of the invention relates in that the floor element is also transportable on account of its flexural rigidity and can be delivered to a construction site as a prefabricated component which is manufactured in a large number.

In a further advantageous embodiment, a vapor barrier which, according to the invention, extends beyond the end sides of the outer wall elements is provided on that side of the outer wall elements which faces the interior. Here, the vapor barrier is disposed between an inner lining and a thermal insulation layer of the outer wall element, it also being possible, however, for the inner lining to be configured as a composite plate having an integrated vapor barrier. In the corner region of the spatial unit, the vapor barriers which preferably contain a coated paper film or a plastic film extend into the recess from the end face, the vapor barriers which extend beyond the end sides being connected to one another, for example, by an adhesive bond, in order to seal the interior which is enclosed by the outer wall elements. In particular in the case of a great temperature gradient between the inner side and the outer side of the outer wall elements, the vapor barrier advantageously prevents the entry of damp ambient air into the interior of the outer wall element and corner element, as a result of which the formation of condensation and therefore a reduction in the thermal insulation capacity of the outer wall elements and corner elements on account of wetting of the thermal insulation layer is avoided. As a result of the connection of the vapor barriers of the adjacent outer wall elements in the corner regions of the spatial unit, the interior which is enclosed by the outer wall elements is advantageously closed off in a windproof and vaporproof manner. This is preferably valid for all end faces of the outer wall elements, that is to say the lower, upper and lateral end faces of each outer wall element.

Furthermore, according to the invention, there can be provision for those vapor barriers of two adjacent outer wall elements which extend beyond the end sides in the corner region of the spatial unit to be connected to one another via a self-adhesive film. The self-adhesive film which assumes the role of a vapor barrier in the region of the recess is preferably a conventional adhesive tape which, after mounting of the outer wall elements, is adhesively bonded to their end sides, fixes the vapor barriers on the respective end side of the outer wall elements and extends from the end side of one outer wall element via the bent-in corner to the end side of the adjacent outer wall element. The simple mounting of a self-adhesive film of this type results in the advantage that the region of the recess can be sealed inexpensively, the self-adhesive film preferably having a fold in the region of the adjacent edges of the end sides, which fold makes a relative movement possible of the outer wall elements with respect to one another, for example as a result of thermal expansion, and in the process prevents ripping of the self-adhesive film.

According to a further embodiment of the invention, the corner element contains at least one thermal insulation layer and one lining. The thermal insulation layer is enclosed by the lining and the end sides of the outer wall elements which adjoin one another in the corner region of the spatial unit. The lining which is composed, in particular, of sheet metal, plastic material or wood closes off the thermal insulation layer to the outside and therefore prevents its being wetted or damaged. During the mounting of the corner element, after the introduction of the thermal insulation layer into the recess, the lining is preferably fastened in the recess with a screw or clamped connection, the fastening points not being predefined. This results in the advantage that the corner element can contain standardized components and can be fastened simply and accurately in recesses having different dimensions.

As an alternative, however, the corner element can also contain a plastic hollow profile, in particular made from polyurethane, which is filled with thermally insulating material, the cross section of the hollow profile having at least two limb faces which are assigned to the end faces of the outer wall elements.

In a further advantageous embodiment of the invention, the corner elements can be adhesively bonded into the recesses. After mounting of two adjacent outer wall elements in the corner region of a spatial unit, the corner element can therefore be adhesively bonded to the faces which are assigned to the end sides of the outer wall elements. The adhesive bond between the corner element and the end sides of the outer wall elements can be produced, for example, by single-component or multiple-component liquid adhesive, by way of a self-adhesive double-sided adhesive tape or else by way of hot-melt adhesive, it being possible for the adhesive bond to be of releasable configuration, in particular by a separating thread or separating wire which is introduced into the adhesive bond, for subsequent dismantling of the outer wall elements and of the corner element. The adhesive bond between the end side of an outer wall element and the corresponding face of a corner element is severed here by tautening of the separating thread which is preferably incorporated in the adhesive in a wave-shaped and loose manner. As a result, the outer wall elements and the corner element can advantageously also be reused after dismantling.

In order to support the spatial unit on the subsoil, foundations are provided in the corner region of the spatial unit, on which foundations the spatial unit is supported. The foundations are preferably prefabricated individual or strip foundations which are made from reinforced concrete, are to be placed only at the locations provided for this purpose on the building plot and are preferably configured in multiple pieces for easier transport. After dismantling and transporting away of the spatial unit, this results in the advantage that the foundations can also be removed and reused, with the result that the subsoil can be used in a lasting manner and can be returned to the original state with low costs.

Furthermore, according to the invention, there can be provision for at least one leveling element which serves to equalize different heights of the foundations to be disposed between the spatial unit and the foundations. When the foundations are sunk, this results in the advantage that there is a greater tolerance in relation to the height of the individual foundations and, in the case of uneven subsoil or else when a foundation is sunk, the height difference can also still be equalized retrospectively by the leveling element and the spatial unit can be oriented horizontally.

If a building construction is made having at least one first and one second spatial unit which are connected to one another, the spatial units can be disposed next to one another or above one another and also next to one another and above one another according to the invention. In order to increase or reduce the building construction, the spatial units are advantageously connected releasably to one another according to the invention. Here, the free outer sides of the building construction are substantially enclosed by the outer wall elements which are disposed above one another and next to one another. A large number of different possible combinations of the first and second spatial units results in the further advantage that the constructor is given a high degree of flexibility in the configuration of his building construction.

According to a further embodiment according to the invention, the spatial units can be disposed at a spacing from one another, it being possible for coupling elements to be fastened releasably between the adjacent end sides of the outer wall elements of the spatial units which are disposed spaced apart from one another. Here, the coupling elements serve, in particular, to seal the interior which is enclosed by the outer wall elements in the region between the spatial units which are disposed spaced apart from one another, and can be a constituent part of the outer walls of the building construction which are defined by the outer wall elements and face the side, roof and floor.

As the spatial units according to the invention can be used to construct a building construction, the ground plan of which has a shape which deviates from the rectangular shape, such as an L shape, T shape or even a star shape, this results in the advantage of high variability in the design of the ground plan.

Like the outer wall elements, the coupling elements also have a carrying frame and thermal insulation which are protected against mechanical damage and weather influences by an enclosing outer lining. As the coupling elements do not assume a loadbearing function and as a consequence only have to support themselves, they can advantageously be manufactured industrially in large numbers on account of their simple construction.

Here, the shape of the coupling elements is dependent on the shape of the ground plan, in particular the angle between the end sides of the outer wall elements of the spatial units which are disposed spaced apart from one another, and on the spacing between the spatial units. In the case of an L-shaped ground plan, the building construction has, for example, a bent-in corner having two outer wall elements which are disposed at a right angle with respect to one another and the adjacent end sides of which are connected to one another via the coupling element. For this purpose, the coupling element has two side faces which are disposed at a right angle with respect to one another, face the end sides of the outer wall elements and are connected releasably to the latter.

In order to seal in a windproof and vaporproof manner the interior which is enclosed by the outer wall elements and coupling elements, the coupling elements contain vapor barriers which extend beyond the sides of the coupling elements which face the end sides of the outer wall elements. The vapor barriers which are composed, in particular, of a paper film or plastic film are preferably adhesively bonded to the vapor barriers of the adjacent outer wall elements, but can also be connected to the latter in another way.

The spacing between the adjacent spatial units preferably lies in a range from 20 cm to 50 cm and is dependent on the thickness of the adjacent outer wall elements of the spatial units which are disposed spaced apart from one another and also on the angle with respect to one another. As the outer wall elements preferably have a thickness of 30 cm, a spacing of 30 cm has proven particularly advantageous, for example, for an L-shaped ground plan of the building construction.

The intermediate space which is obtained by the spacing apart of the spatial units can advantageously be used as an additional living space or for installation of a fitted cupboard. For this purpose, a single-piece or multiple-piece floor element and/or ceiling element are/is fastened releasably between the adjacent spatial units to the latter. Here, the floor element or the ceiling element can either be connected to the longitudinal frames and/or crossmembers of the adjacent spatial units or else can be screwed to the latter.

Furthermore, it is conceivable that the intermediate space between the spatial units serves to accommodate supply and discharge lines, such as gas lines, wastewater lines and fresh water lines.

For reasons of noise insulation and for unimpeded thermal expansion, a damping element which is composed, in particular, of neoprene is provided according to the invention between the spatial units which are disposed next to one another or above one another.

In a further advantageous embodiment of the invention, in order to seal joints which are disposed between the end sides of the outer wall elements, a sealing band or tube which contain, in particular, a permanently elastic polyurethane foam plastic or EPDM which is impregnated with bitumen is disposed in the joints. Here, the sealing band serves as wind seal and, furthermore, prevents ingress of moisture into the interior of the building construction and into the intermediate spaces which are situated between the outer wall elements and the outer sides of the spatial unit.

Furthermore, in order to avoid the formation of condensation water in the region of the outer wall elements, coupling elements and/or corner elements, a rear-ventilated facade which is disposed spaced apart is provided according to the invention in front of the outer wall elements. This results in the advantage that an outer water-repellent surface can be omitted in the outer wall elements, it being conceivable that, for example, thermal insulation mats from rock wool are integrated into the outer wall elements and the outer wall elements can face the rear-ventilated facade directly without an additional covering.

The spatial units can be divided in a manner according to the invention by inner wall elements within the interior which is enclosed by the outer wall elements. The inner wall elements are preferably a dividing wall system which is known from the prior art and is made from wood material plates, or lightweight partition walls which have a frame construction made from wood with advanced gypsum plasterboards.

Other features which are considered as characteristic for the invention are set forth in the appended claims.

Although the invention is illustrated and described herein as embodied in a self-supporting spatial unit having non-supporting advanced outer walls, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
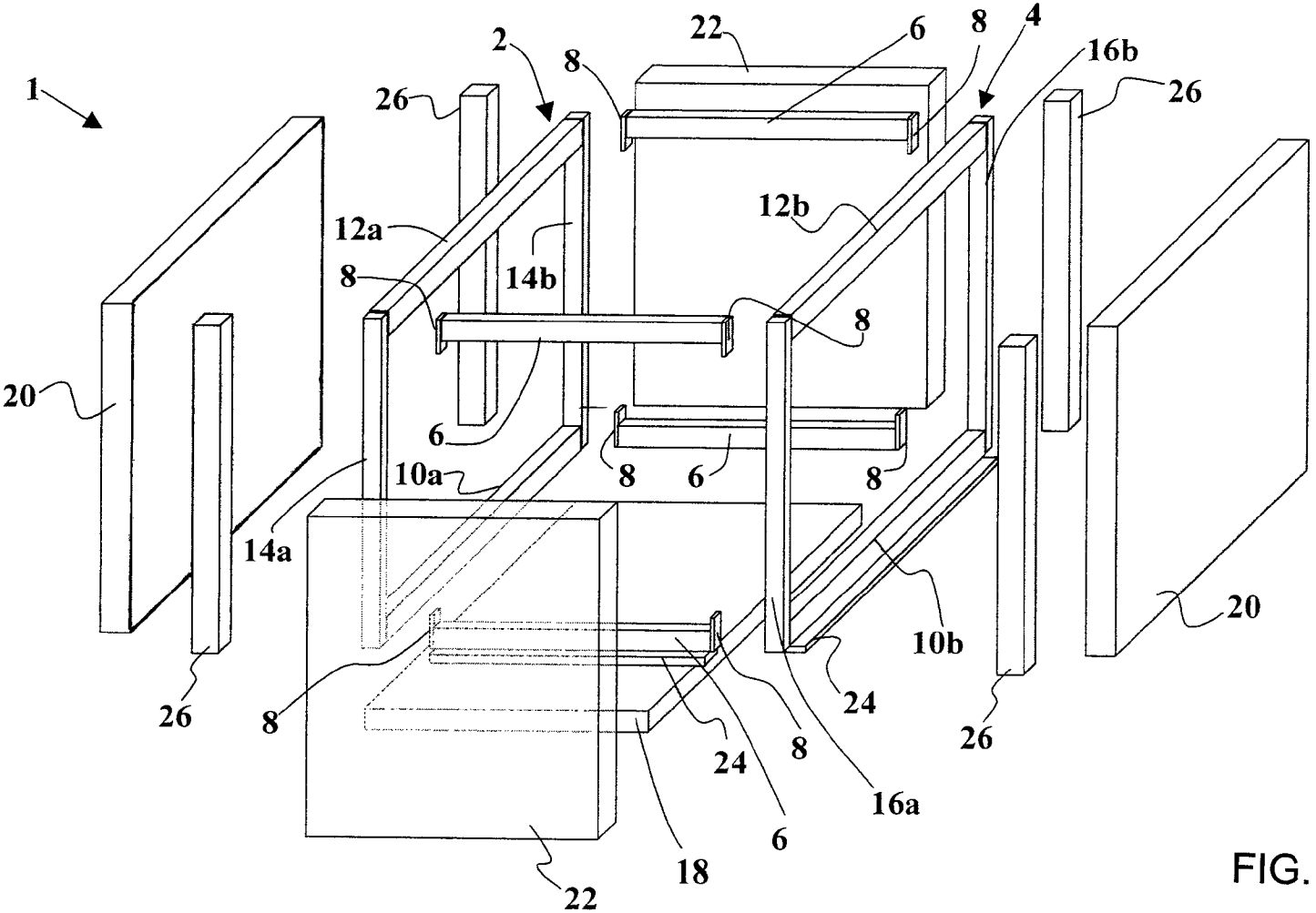
FIG. 1A is a diagrammatic, exploded, three-dimensional view of a single spatial unit according to the invention having a floor, outer wall elements and corner elements.

Referring now to the figures of the drawing in detail and first, particularly, to FIG. 1A thereof, there is shown a spatial unit 1 having a first and a second rectangular, substantially closed longitudinal frame 2, 4 which are connected releasably to one another via four crossmembers 6, the spatial unit 1 containing, in particular, steel profiles. Here, the crossmembers 6 have in each case at their ends an end plate 8, by way of which they are connected to the longitudinal frames 2, 4 in the corner region of the latter. As the applicant has discovered, a screw connection (not shown further in FIG. 1A) of the longitudinal frames 2, 4 to the end plate 8 of the crossmembers 6 has proven particularly advantageous for the transmission of bending moments and transverse forces between the crossmembers 6 and the longitudinal frames 2, 4. Furthermore, the releasable connection of the longitudinal frames 2, 4 and the crossmembers 6 affords the advantage that the spatial unit 1 can be transported simply in a manner which is dismantled into individual parts.

The longitudinal frames 2, 4 contain in each case a first lower and a second upper longitudinal carrier 10*a*, 10*b*, 12*a*, 12*b* which are connected by way of their end sides via a support 14*a*, 14*b*, 16*a*, 16*b* which is disposed at a right angle with respect to the former, to form a self-supporting, independent frame. The supports 14*a*, 14*b*, 16*a*, 16*b* are preferably formed from a square hollow profile and have a length which corresponds substantially to the height of the spatial unit 1. Like the crossmembers 6, the longitudinal carriers 10*a*, 10*b*, 12*a*, 12*b* can likewise be welded by way of an end plate connection to the respective upper or lower end of the supports 14*a*, 14*b*, 16*a*, 16*b* with one limb face of the square hollow profile of the support 14*a*, 14*b*, 16*a*, 16*b*, or else can be screwed releasably to the supports 14*a*, 14*b*, 16*a*, 16*b* or else can be plugged. Here, the interior of the square hollow profile of the support 14*a*, 14*b*, 16*a*, 16*b* can advantageously be used to accommodate electrical or other supply and discharge lines.

The longitudinal carriers and crossmembers 6, 10*a*, 10*b*, 12*a*, 12*b* have an open U-shaped cross section (which cannot be seen in FIG. 1A) having a substantially identical profile height, the openings of the U-shaped cross section of the crossmembers and longitudinal carriers 6, 10*a*, 10*b*, 12*a*, 12*b* pointing in the direction of the interior of the spatial unit. Before the two longitudinal frames 2, 4 are connected via the lower crossmembers 6, a self-supporting floor element 18 can advantageously be inserted into the open cross sections of the profiles of the lower longitudinal carriers 10*a*, 10*b*, the floor element 18 resting on the lower limb faces (not shown in FIG. 1A) of the U-shaped cross section of the crossmembers and longitudinal carriers 6, 10*a*, 10*b*, 12*a*, 12*b*. Here, the self-supporting floor element 18 is, in particular, a trapezoidally corrugated sheet and is configured structurally to be flexurally rigid in such a way that it remains virtually flat in the case of a ceiling loading which is customary for residential and commercial buildings, and does not sag. In the same way, however, the floor element 18 can also be composed of a large number of individual rod-shaped or bar-shaped individual elements, as a result of which the transport and mounting are again simplified.

In order to protect the interior of the spatial unit 1 against weather influences, self-supporting non-reinforcing outer wall elements 20, 22 can be disposed both on the longitudinal sides and broad sides and on the upper and lower sides of the spatial unit 1, the length and height of the outer wall elements 20, 22 corresponding substantially to the height and length or height and width of the spatial unit 1. Here, the outer edges of the outer wall elements 20, 22 terminate substantially flushly with the outer edges of the spatial unit 1.

During the mounting of the outer wall elements 20, 22 on the longitudinal side and broad side of the spatial unit 1, they are placed releasably on supporting strips 24 which are attached in the lower region of the spatial unit 1, and are screwed to the spatial unit 1 in the upper region of the outer wall element 20, 22, the supporting strips 24 preferably being disposed on the lower crossmembers and longitudinal carriers 6, 10*a*, 10*b*. Here, the supporting strips 24 can be a metal sheet which is disposed on the crossmembers and longitudinal carriers 6, 10*a*, 10*b* or an elbow, which are screwed, welded or fastened in another way to the lower longitudinal carriers 10*a*, 10*b* and the lower crossmembers 6. Furthermore, the outer wall elements 20, 22 are preferably screwed to the upper crossmembers and longitudinal carriers 6, 12*a*, 12*b*, but can also be connected to lugs (not shown in FIG. 1A) which are attached to the crossmembers and longitudinal carriers 6, 12*a*, 12*b*.

The outer wall elements 20*a*, 20*b* which are disposed on the upper and lower side of the spatial unit 1 and are not shown in FIG. 1A for illustrational reasons are preferably connected to the crossmembers and longitudinal carriers 6, 10*a*, 10*b*, 12*a*, 12*b* via a screw connection, but can also merely rest on the latter or be attached to them.

According to the invention, the bent-in corner or recess which is produced in the corner region of the spatial unit 1 after mounting of two adjacent outer wall elements 20, 22 is closed or filled by a corner element 26, the corner element 26 being adhesively bonded, screwed or fastened via a clamped connection to the end sides of the outer wall elements 20, 22.

Figure 1B:
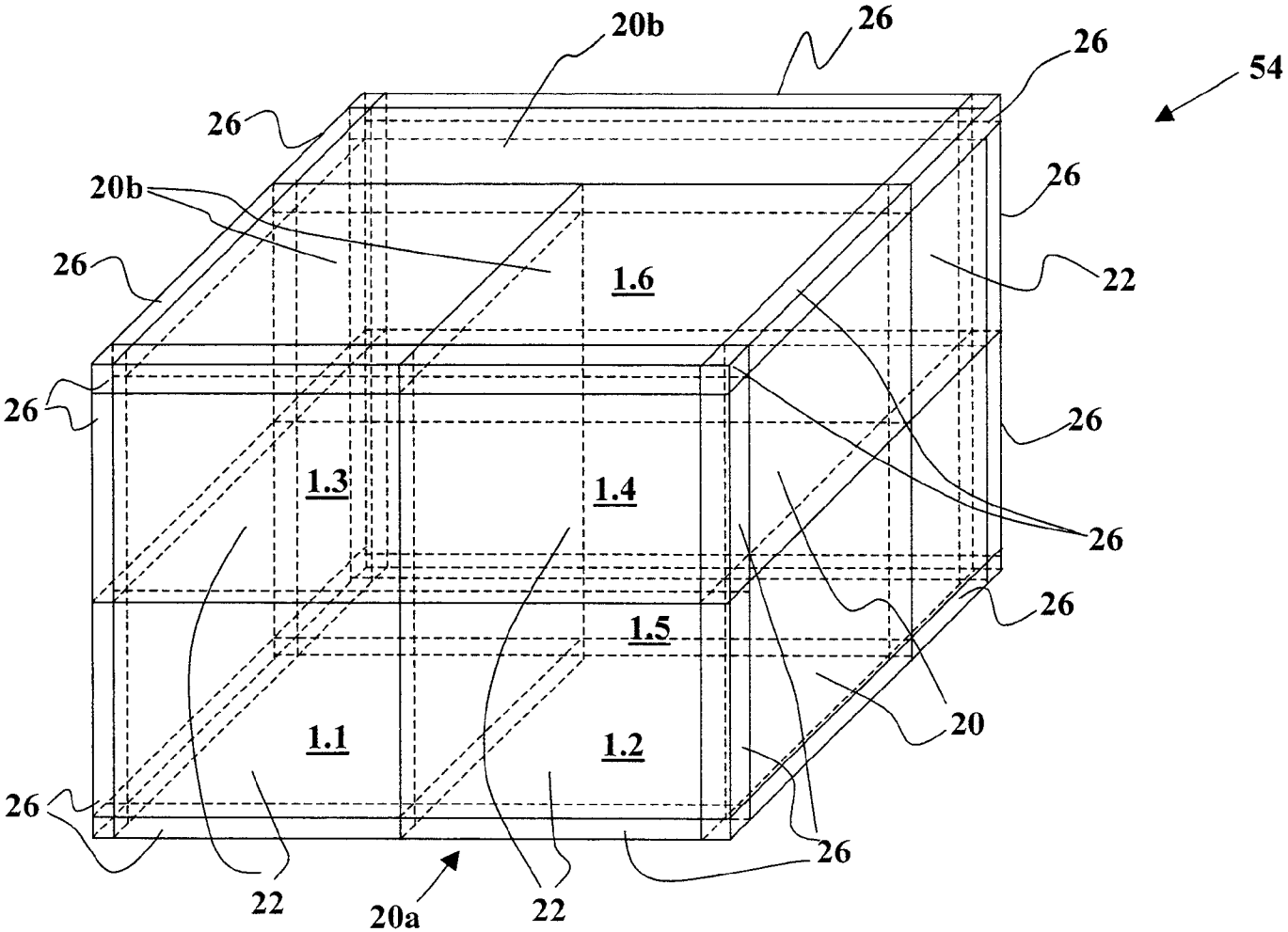
FIG. 1B is a diagrammatic, three-dimensional view of the spatial units according to the invention which are disposed above one another and next to one another and have outer wall elements and corner elements.

In this context, FIG. 1B shows a two-story building construction 54 which contains in each case two spatial units 1.1, 1.2, 1.3, 1.4 which are disposed next to one another and above one another with parallel adjacent longitudinal sides and two spatial units 1.5, 1.6 which are disposed above one another at a right angle with respect to the former on the broad sides. The spatial units 1.1, 1.2, 1.3, 1.4, 1.5, 1.6 are enclosed by outer wall elements 20, 20*a*, 20*b*, 22 on their outer sides which extend in the horizontal and vertical directions and by corner elements 26 in the corner region, the outer wall elements 20, 20*a*, 20*b*, 22 and the corner elements 26 either forming a flat surface which is shown in FIG. 1B or it being possible for them to merge in a stepped manner into one another, as is shown, for example, in FIG. 2. Here, the outer wall and corner elements 20, 20*a*, 20*b*, 22, 26 which are disposed on the spatial units 1.1, 1.2, 1.3, 1.4, 1.5, 1.6 form the shape of a closed rectangle in the plan and side views.

Figure 2:
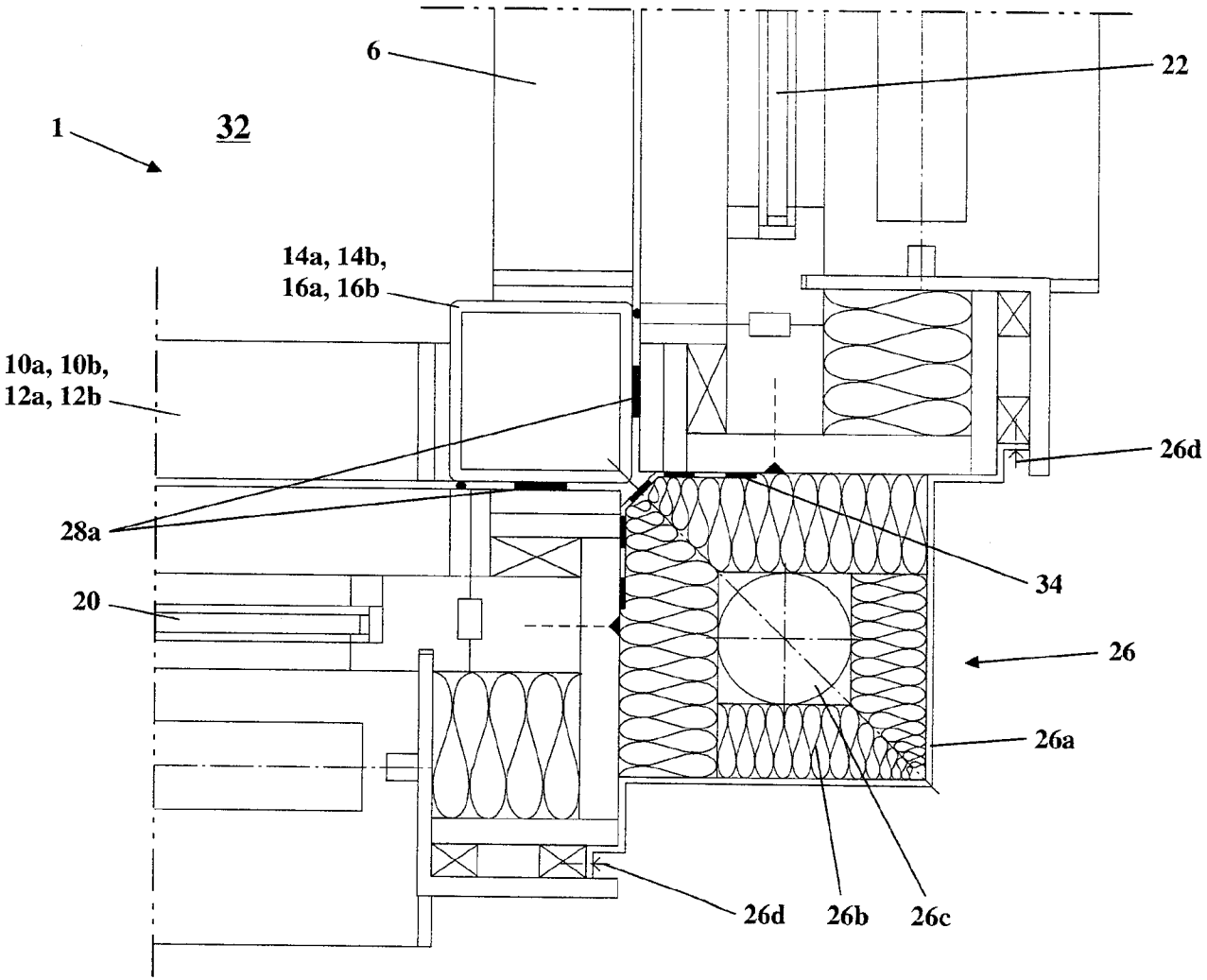
FIG. 2 is a diagrammatic, sectional view of a corner region of the spatial unit according to the invention having outer wall elements which are disposed on the outer sides of the spatial units and having a corner element which is adhesively bonded in the corner region.

FIG. 2 shows the corner region of the spatial unit 1 having outer wall elements 20, 22 which are disposed on the outer sides of the spatial unit 1 and bear against the outwardly pointing limb faces of the associated support 14*a*, 14*b*, 16*a*, 16*b* and the crossmembers and longitudinal carriers 6, 10*a*, 10*b*, 12*a*, 12*b*. Here, a sealing band 28*a* is disposed between the outer wall elements 20, 22 and those limb faces of the supports 14*a*, 14*b*, 16*a*, 16*b* which face the outer wall elements 20, 22, in order to prevent the exchange of air masses of different temperatures and the ingress of moisture into the interior of the space which is enclosed by the outer wall elements 20, 22, and in order to reduce the transmission of sound.

A corner element 26 is inserted into the bent-in corner of the spatial unit 1 of FIG. 2, which corner element 26 has thermal insulation 26*b* which bears against the end sides of the outer wall elements 20, 22 and is protected against damage and moisture to the outside by a lining 26*a*. A line such as a rainwater pipe 26*c* which is enclosed by the thermal insulation 26*b* can be disposed in the interior of the corner element 26. The outer lining 26*a* is fastened in the recess via a screw connection 26*d*, the position of the fastening points in the recess not being predefined. Here, the lining 26*a* preferably contains a resilient metal sheet or plastic which is capable of adaptation to the relative displacement of the outer wall elements 20, 22 with respect to one another, for example as a result of thermal expansion.

A vapor barrier 34 which is connected to those vapor barriers (not shown in FIG. 2) of the outer wall elements 20, 22 which protrude beyond the end faces of the outer wall elements 20, 22 is disposed between the end sides of the outer wall elements 20, 22 and the corner element 26. Here, the vapor barrier 34 extends from the end face of the outer wall element 20 to the end face of the outer wall element 22 and in this way seals the corner region of the spatial unit in a wind proof and vapor proof manner. The vapor barrier 34 is preferably a conventional adhesive tape which is adhesively bonded onto the end faces of the outer wall elements 20, 22 and to their vapor barriers.

As a result of the arrangement of the corner element 26 in the bent-in corner of the spatial unit 1 and the further sealing by the sealing band 28*a* and the vapor barrier 34, an interior 32 which is delimited by the outer wall elements 20, 22 is advantageously closed off to the outside and protected against weather influences.

Figure 3:
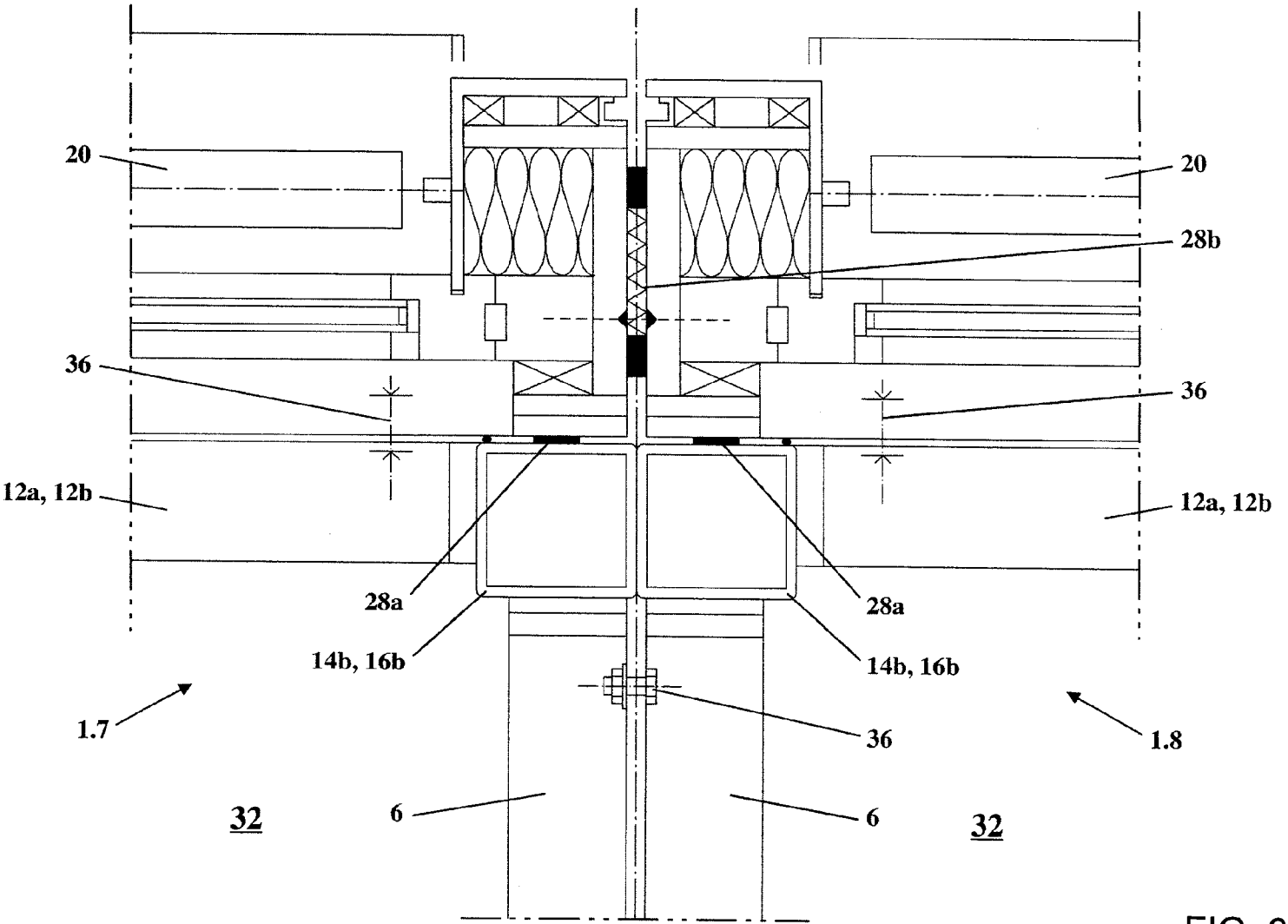
FIG. 3 is a diagrammatic, sectional view of a section of two adjacent spatial units having outer wall elements which are disposed on the outer sides of the spatial units.

FIG. 3 shows two spatial units 1.7, 1.8 which are disposed next to one another and have outer wall elements 20 which are disposed on the outer side. As has already been shown in FIG. 2, a sealing band 28*a* is also provided here on those limb faces of the supports 14*b*, 16*b* which face the outer wall elements 20, for unimpeded thermal expansion of the outer wall elements 20. Here, the outer wall elements 20 which are disposed on the outer sides of the spatial units 1 adjoin one another with their end sides, the joint which is situated between the end sides of the outer wall elements 20 being filled by a further sealing band 28*b* or sealing tube which contains, in particular, a permanently elastic polyurethane foam plastic or EPDM which is impregnated with bitumen, and the vapor barriers (not shown in FIG. 3) of the outer wall elements 20 being connected to one another at this location. As shown in FIG. 3, the outer wall elements 20 are screwed to the upper longitudinal carriers 12*a*, 12*b*, the upper longitudinal carriers 12*a*, 12*b* having non-illustrated recesses and the outer wall elements 20 having non-illustrated threaded sections which are integrated into the outer wall elements 20 and by way of which the outer wall elements 20 can be fastened to the longitudinal carriers 12*a*, 12*b* via a screw connection. In order to couple the adjacent outer sides of two spatial units 1.7, 1.8, the adjacent crossmembers 6 can be connected releasably to one another via a screw connection 36.

Figure 4:
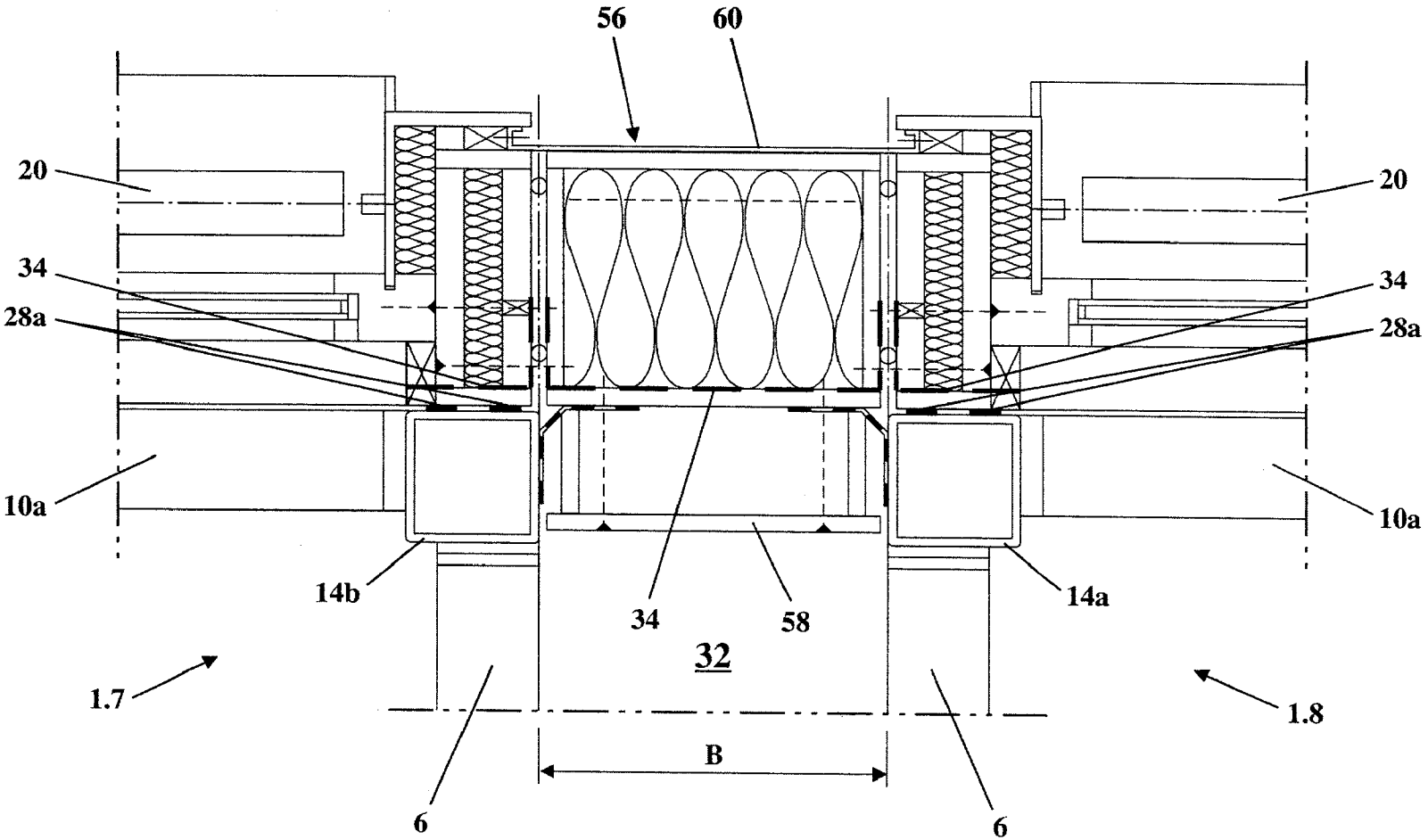
FIG. 4 is a diagrammatic, sectional view of a section of two spatial units which are disposed spaced apart next to one another and have outer wall elements which are disposed on the outer sides of the spatial units and a coupling element which is disposed between the outer wall elements.

In the same way as FIG. 3, FIG. 4 also shows two spatial units 1.7, 1.8 which are disposed next to one another and have outer wall elements 20 which are fastened to the outer side of the spatial units 1.7, 1.8, the spatial units 1.7, 1.8 which are shown in FIG. 4 are disposed spaced apart from one another, however. Here, a spacing B between the spatial units 1.7, 1.8 lies in the range which corresponds approximately to the thickness of the outer wall elements 20.

A coupling element 56 which is connected to the end sides of the outer wall elements 20 is disposed between those end sides of the outer wall elements 20 of the spatial units 1.7, 1.8 which are disposed spaced apart from one another which lie opposite one another and face one another. In the same way as the outer wall elements 20, 22, the coupling element 56 also has a carrying frame which is provided with a thermal insulation layer and a vapor barrier 34. Here, the vapor barrier extends beyond the sides which face the end sides of the outer wall elements 20 and is preferably connected to the vapor barriers 34 of the outer wall elements 20 via an adhesive bond in a manner which is impermeable to wind and vapor. As weather protection, the coupling element 56 is lined from the outside with a stapled or screwed protective covering 60 made from metal or plastic, whereas, for example, a lightweight plate made from gypsum plasterboards can be disposed toward the side of the interior 32 as inner lining 58 between the vertical carriers 14*a*, 14*b*. In order to fasten the coupling element 56, it is either screwed to the outer wall elements 20 or attached releasably to the latter via a plug-in connection.

Figure 5:
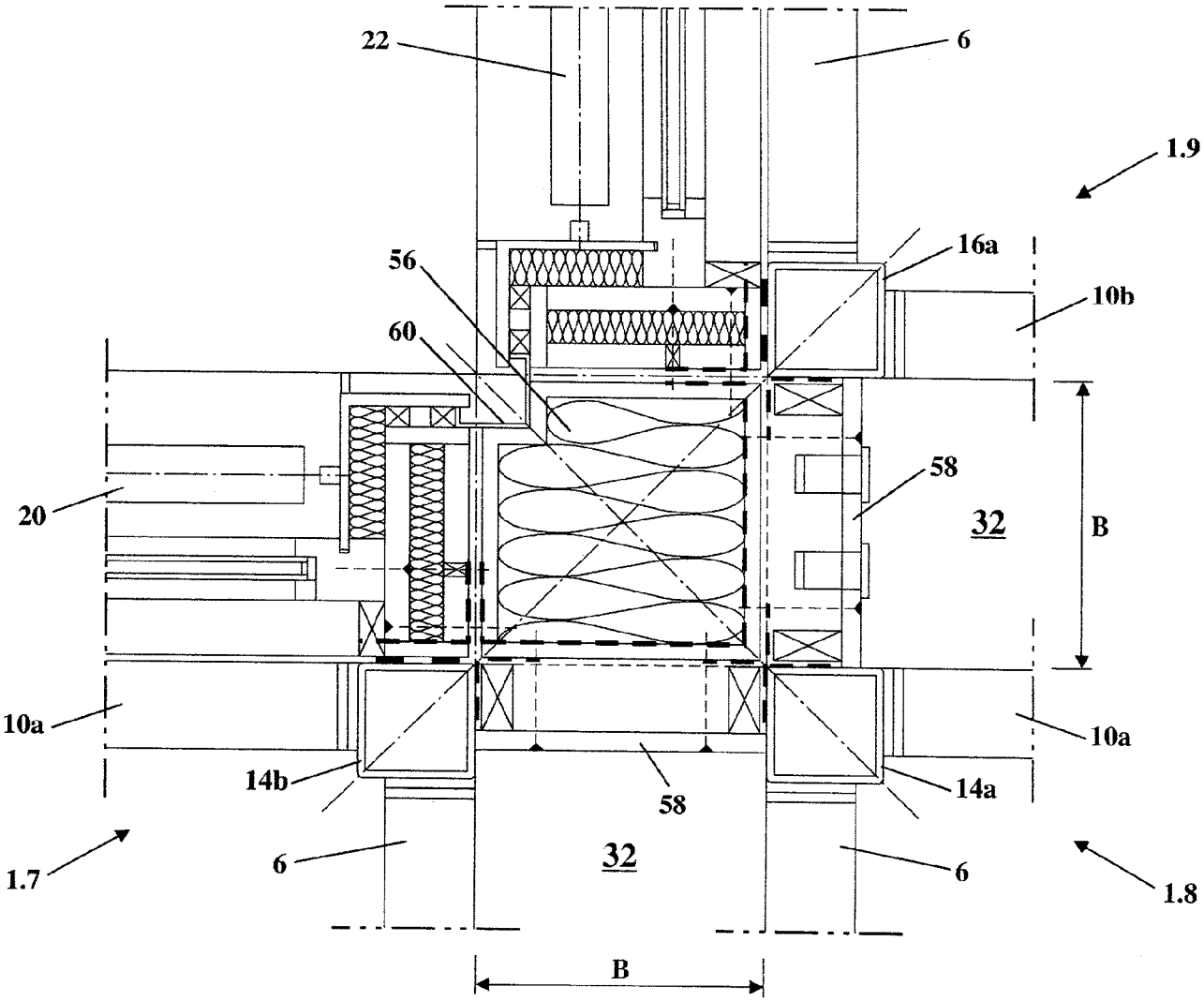
FIG. 5 is a diagrammatic, sectional view of a section of three spatial units which are disposed spaced apart from one another in the region of a bent-in corner of the building construction according to the invention, having outer wall elements which are disposed on the outer sides of the spatial units and a coupling element which is disposed in the region of the bent-in corner.

FIG. 5 shows a further arrangement of spatial units 1.7, 1.8, 1.9, as can be used, for example, in building constructions having an L-shaped ground plan. Here, the arrangement which is shown in FIG. 4 and contains the spatial units 1.7, 1.8 which adjoin one another with their broad sides spaced apart was extended by a further spatial unit 1.9 which adjoins the longitudinal side of the spatial unit 1.8 in a spaced apart manner. For this purpose, the coupling element 56 which is shown in FIG. 4 and the outer wall element 20 which is disposed on the longitudinal side of the spatial unit 1.8 have been replaced by the coupling element 56 which is shown in FIG. 5 and the outer wall element 22 which is disposed on the broad side of the spatial unit 1.9.

The outer walls 20, 22 which are fastened releasably to the outer sides of the spatial unit 1.7, 1.9 lie virtually at a right angle with respect to one another and define a bent-in corner, in which a coupling element 56 is disposed between the end sides of the outer wall elements 20, 22. The spacing B between the spatial units 1.7, 1.8, 1.9 advantageously corresponds substantially to the thickness of the outer wall elements 20, 22, with the result that the coupling element 56 is enclosed to the outside almost completely by the end sides of the outer wall elements 20, 22 which are disposed diagonally with respect to one another. As has already been shown in FIG. 3, a protective covering 60, a facade component (not shown in FIG. 5) or a facade element is fastened as weather protection on that side of the coupling element 56 which is directed outward. Inner linings 58 which preferably contain gypsum plasterboards are disposed in the direction of the interior 32 between the vertical carriers 14*a*, 14*b*, 16*a* of the spatial units 1.7, 1.8, 1.9.

As has also already been shown in FIG. 4, the vapor barrier 34 extends beyond those sides of the coupling element 56 which face the end sides of the outer wall elements 20, 22, which vapor barrier 34 is connected to the vapor barriers 34 of the outer wall elements 20, 22 in a manner which is impermeable to wind and vapor, in particular by an adhesive bond.

Figure 6:
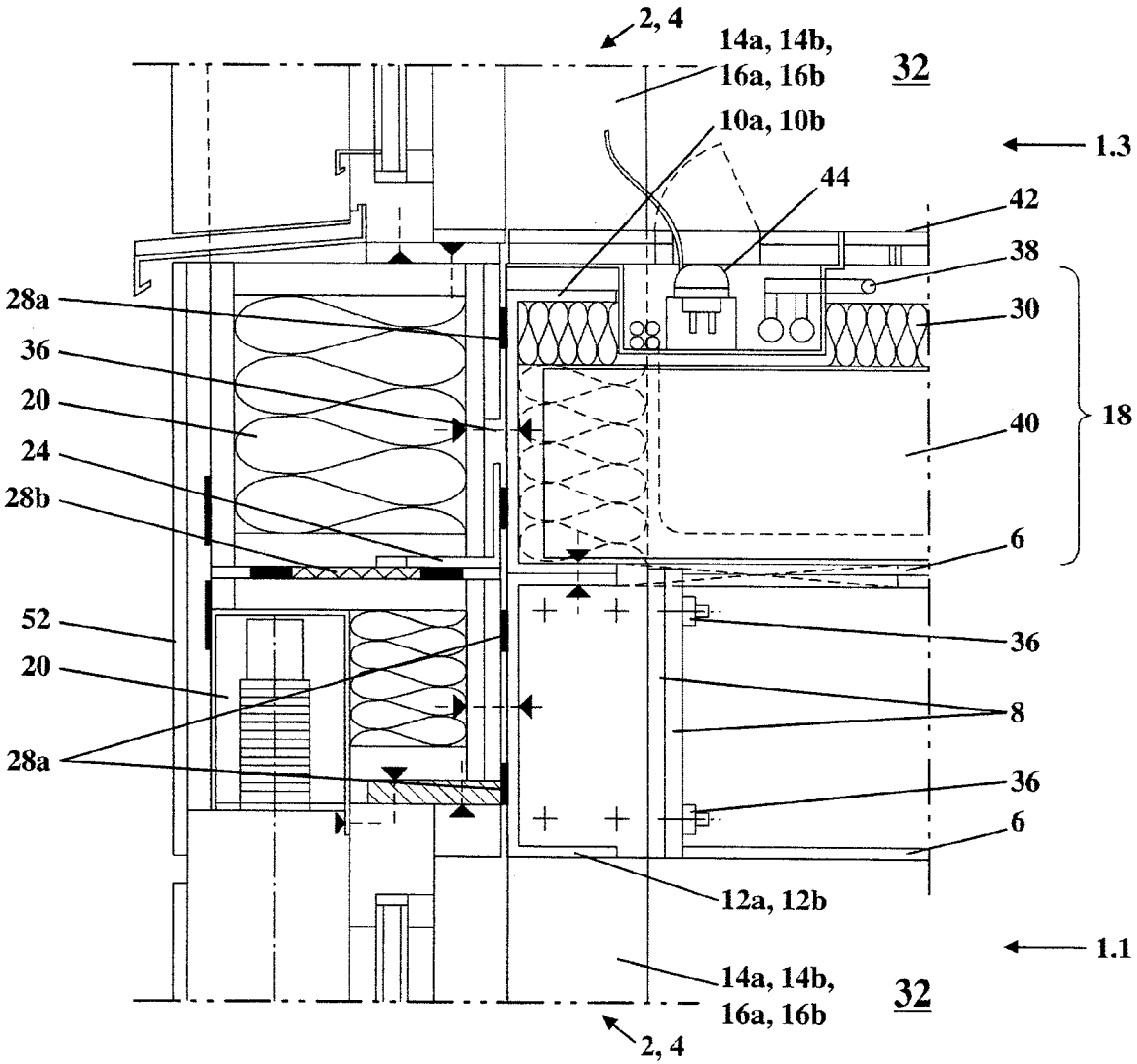
FIG. 6 is a diagrammatic, sectional side view of a section of two spatial units which are disposed above one another and have outer wall elements which are fastened to the outer sides of the spatial units and a floor element which is inserted into the upper spatial unit.

FIG. 6 shows a vertical section through two spatial units 1.1, 1.3 which are disposed above one another, a floor element 18 being disposed in the other spatial unit 1.3. Here, in the outer wall elements 20 which are disposed on the outer sides of the spatial unit 1.3, the upper outer wall element 20 is supported on the limb face of a supporting strip 24 which is disposed in the lower region of the upper spatial unit 1.3, and is additionally screwed against the lower longitudinal carrier 10*a*, 10*b* via a screw connection 36. The supporting strip 24 has an L-shaped cross section, the vertical limb of which is screwed to the lower longitudinal carrier 10*a*, 10*b* of the upper spatial unit 1.3. A sealing band 28*b* is disposed between those end sides of the upper and lower outer wall elements 20 which lie opposite one another, which sealing band 28*b* prevents the ingress of moisture into the interior of the space 32 which is enclosed by the outer wall elements 20, and connects the vapor barriers (not shown in FIG. 6) of the outer wall elements 20 to one another. Further sealing bands 28*a* having smaller cross-sectional dimensions are disposed between the outer wall elements 20 and the longitudinal carriers 10*a*, 10*b*, 12*a*, 12*b*. For the unimpeded thermal expansion of the outer wall elements 20, the sealing bands 28*a*, 28*b* also assume the function of the formation of an expansion joint, in addition to sealing.

As FIG. 6 shows, furthermore, the floor element 18 is enclosed in that frame of the upper spatial unit 1.3 which is formed by the first lower longitudinal carriers 10*a*, 10*b* and crossmembers 6. Here, the floor element 18 has a trapezoidally corrugated sheet 40 as loadbearing component, on which an insulating layer 30 for thermal and sound insulation is attached. In addition, heating elements of an underfloor heating system 38 can also be provided above the insulating layer 30, onto which heating elements a floor 42 is applied as uppermost layer in a known manner. Here, both electrical connections 44 and the installations for heating and water technology are advantageously laid in the floor element 18, with the result that the connection points for the respective consumers, such as the inflow and outflow for a washing machine, can also be provided in the floor element 18. Furthermore, this also results in the advantage that the outer wall elements 20, 22 can be mounted and dismantled in this way without consideration of any supply lines, as all the supply lines are accommodated in the floor.

Instead of a single-piece floor element 18, the latter can also be of multiple-piece configuration according to one embodiment which is not shown, as a result of which the transport of the floor element is made considerably easier.

The ceiling of the lower spatial unit 1.1 can be a suspended ceiling (not shown in greater detail in FIG. 6) which is disposed within the frame which is formed by the upper crossmembers 6 and the upper longitudinal carriers 12*a*, 12*b* of the lower spatial unit 1.1. Here, it is advantageously possible to utilize the electrical connections 44 which are situated in the floor element 18 which is disposed above it for the ceiling lighting, as a result of which complicated laying of additional electrical lines within the suspended ceiling is no longer required. For this purpose, the floor element 18 can be provided with electrical connections 44 both on the upper side and on the lower side.

Furthermore, a rear-ventilated facade 52 which is disposed spaced apart, is connected in a punctiform manner to the outer wall element 20, 22 and can extend over the height of the spatial unit or else of the entire building construction 54 is provided in front of the outer wall elements 20, 22. Here, the rear-ventilated facade 52 serves to avoid the formation of condensation in the region of the outer wall elements.

Furthermore, FIG. 6 shows the connection of the crossmember 6 to the longitudinal carrier 12*a*, 12*b* of the longitudinal frames 2, 4. Here, both the longitudinal carrier 12*a*, 12*b* and the crossmember 6 have end plates 8 which are screwed to one another. The end plates 8 are dimensioned in such a way that, in the case of a multistory configuration, the maximum bending moments and transverse forces which occur can be transmitted with adherence to the standard safety requirements.

Figure 7:
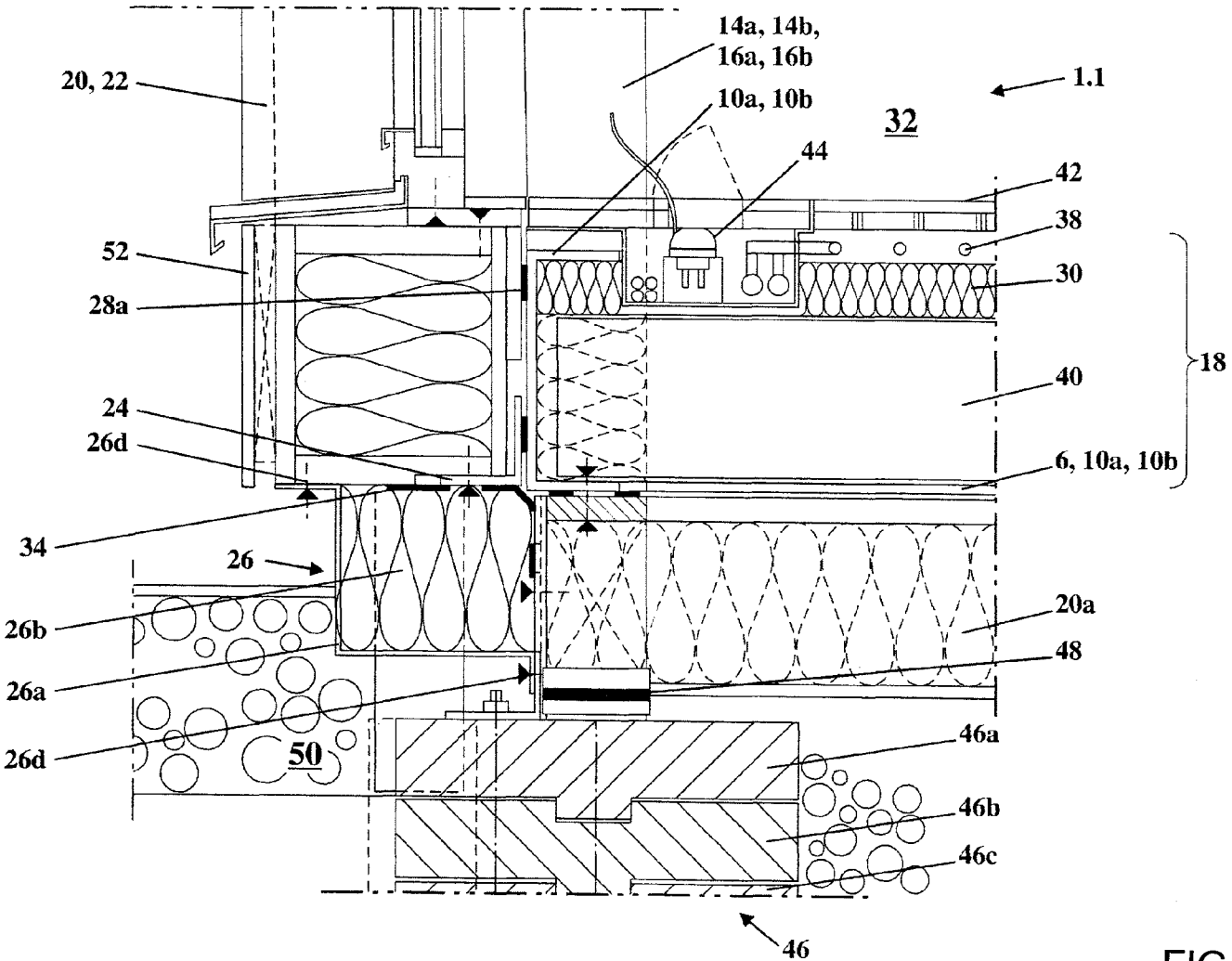
FIG. 7 is a diagrammatic lateral sectional view of a spatial unit according to the invention in the region of the support of the spatial unit on a single foundation.

FIG. 7 shows a vertical section through the lower region of a spatial unit 1.1. As also already shown in the case of the upper spatial unit 1.3 in FIG. 6, a floor element 18 which is provided with electrical and heating technology installations is also disposed here in the lower region of the spatial unit 1.1, and a vertical outer wall element 20, 22 is placed onto an elbow 24 on the outer side of the spatial unit 1.1.

The spatial unit 1.1, and all further spatial units 1.3 which are disposed above it in the case of a multistory building construction, are supported on in each case one multiple-part individual foundation 46 which is disposed in the corner region below the lowermost spatial unit 1.1 and, for easier transport, contains, in particular, a plurality of foundation segments 46*a*, 46*b*, 46*c* which are disposed above one another. In order to equalize a different height of adjacent individual foundations, a leveling element 48 is disposed between the individual foundation 46 and the spatial unit 1.1. The leveling element 48 which is shown only diagrammatically in FIG. 7 can contain a threaded spindle, via which the level equalization preferably of each spatial unit 1.1, 1.2, 1.5 can be carried out manually subsequently. For this purpose, the leveling element 48 is screwed to the spatial unit 1.1 and the individual foundation 46, but can also be set into the concrete of the individual foundation 46.

For the thermal insulation of the building construction which is formed from the spatial units 1 with respect to the subsoil 50, floor-side outer wall elements which are provided with thermal insulation, as floor terminating elements 20*a* preferably have the same width and the same length as the associated spatial units 1.1, 1.2, 1.5 and terminate flushly with the outer edges of the frame which is formed from the crossmembers and longitudinal carriers 6, 10*a*, 10*b* are provided below the spatial units, for example below the lower spatial units 1.1, 1.2, 1.5 which are shown in FIG. 1B. Here, the floor terminating element 20*a* can be attached to the lower spatial unit 1.1 or can be connected to the latter via a non-illustrated screw connection. The flush termination of the floor terminating element 20*a* and the outer wall element 20, 22 with the outer edge of the spatial unit results in a bent-in corner in the corner region, which bent-in corner, as shown in FIG. 2, can be filled in turn by a floor-side corner element 26. The floor-side corner element 26 has thermal insulation 26*b* which is enclosed by the end sides of the vertical outer wall element 20, 22, the floor terminating element 20*a* and an outer lining 26*a*.

As was already also the case in the corner region (see FIG. 2) of the spatial unit 1, the lining 26*a* is fastened releasably in the recess via a screw connection 26*d*. In order to seal the floor-side corner region of the spatial unit 1.1, a vapor barrier 34 extends from the end side of the outer wall element 20, 22 to the end side of the floor terminating element 20*a* and connects the vapor barriers (not shown in greater detail in FIG. 7) of the outer wall element 20, 22 and the floor terminating element 20*a* to one another.

Figure 8:
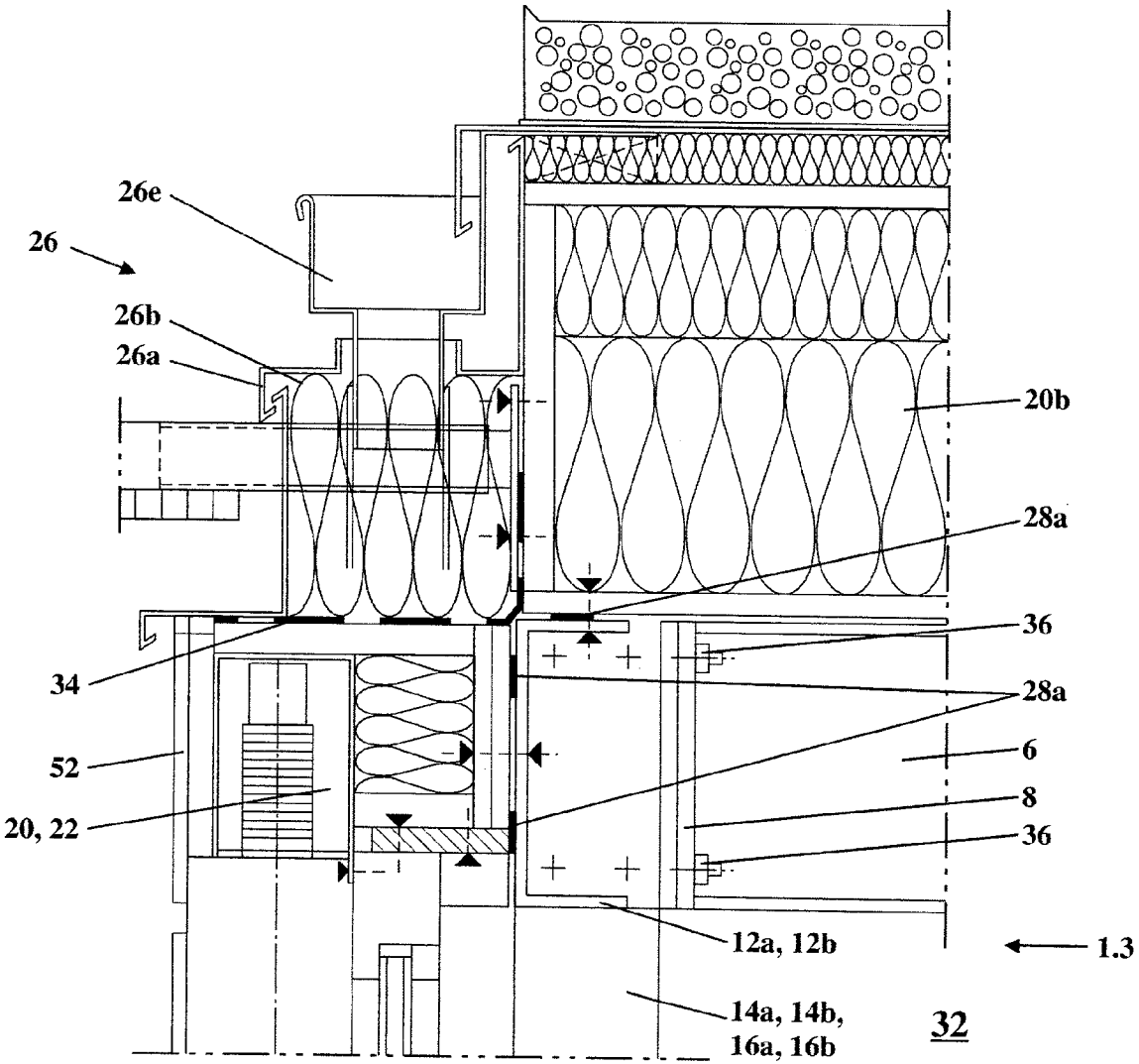
FIG. 8 is a diagrammatic sectional view of the transition according to the invention from an outer wall element which is disposed horizontally and forms a roof surface to a vertically disposed outer wall element.

In the same way as for the thermal insulation with respect to the subsoil 50, roof-side outer wall elements which are provided with thermal insulation (denoted as roof elements 20*b* in the further text) and corner elements 26 are disposed on the upper sides of the upper spatial units 1.3, 1.4, 1.6 which are shown in FIG. 1B, for thermal insulation of the roof surface of the building construction 54. Here, FIG. 8 shows a detail from the corner region of a spatial unit 1.3 with the transition from a vertical outer wall element 20, 22 to a horizontal roof element 20*b* which is supported on the second upper longitudinal carrier 12*a*, 12*b* and the crossmember 6. As has also already been shown in the previous figures, sealing bands 28*a* are disposed between the outer wall element 20, 22 or roof element 20*b* and the support 14*a*, 14*b*, 16*a*, 16*b*, the second upper longitudinal carrier 12*a*, 12*b* and the crossmember 6, in order to seal the expansion joints. Here, the roof element 20*b* lies on the frame which is formed by the second upper longitudinal carriers and crossmembers 12*a*, 12*b*, 6, and is preferably connected to the latter via connecting means (not shown in FIG. 8), such as screw connections or plug-in connections. Here, the roof element 20*b* contains a construction of thermal insulation and roof covering which is known from the field of flat roofs.

As has already been shown in FIG. 2 and FIG. 7, the recess which results in the shape of a bent-in corner as a result of the flush termination of the roof element 20*b* and the outer wall element 20, 22 with the outer edge of the spatial unit 1.3 in the corner region is filled with a corner element 26. Here, the corner element contains an outer lining 26*a* which extends from the end side of the outer wall element 20, 22 to the end side of the roof element 20*b* and closes off to the outside thermal insulation 26*b* which is disposed in the bent-in corner. In order to discharge rainwater, the outer lining 26*a* has a section in the form of a rainwater gutter 26*e* which discharges the rainwater which collects on the roof surface. Furthermore, in order to seal the roof-side corner region of the spatial unit 1.3, a vapor barrier 34 is provided which connects the vapor barrier (not shown in FIG. 8) of the outer wall element 20, 22 to that of the roof element 20*b* and seals the corner region of the spatial unit 1.3 in a manner which is impermeable to wind and vapor.

The invention claimed is:

1. A self-supporting spatial unit, comprising:

crossmembers having outer edges, first and second rectangular, substantially closed longitudinal frames connected releasably to one another via said crossmembers and having outer edges, said longitudinal frames and said crossmembers forming a three-dimensional, self-supporting frame construction;

outer wall elements having outer edges and fastened releasably to said first and second longitudinal frames, said outer wall elements being substantially of a size corresponding to a height, a width or length of the spatial unit, said outer edges of said outer wall elements terminating flushly with said outer edges of said longitudinal frames and of said crossmembers;

a plurality of corner regions including bent-in corners defined by recesses formed by end sides of adjacent ones of said outer wall elements; and corner elements fastened releasably in said recesses, said corner elements seal an interior of the spatial unit delimited by said outer wall elements;

wherein said corner elements include at least one thermal insulation layer and one lining, said lining is fastened to said outer wall elements, and said at least one thermal insulation layer is delimited by said lining and end sides of said outer wall elements.

2. The spatial unit according to claim 1, wherein the length of the spatial unit is twice as great as the width of the spatial unit.

3. The spatial unit according to claim 1, wherein the height and the width of the spatial unit are less than 350 cm and the length being less than 650 cm.

4. The spatial unit according to claim 3, wherein:

said height of the spatial unit is 298 cm;

said width of the spatial unit is 265 cm; and said length of the spatial unit is 530 cm.

5. The spatial unit according to claim 1, further comprising end plate connections connecting said crossmembers in a flexurally rigid manner to said longitudinal frames.

6. The spatial unit according to claim 1, wherein said longitudinal frames each include:

first and second supports disposed at an end region of said first and second longitudinal carriers;

a lower longitudinal carrier; and an upper longitudinal carrier, said lower longitudinal carrier and said upper longitudinal carrier connected in a flexurally rigid manner to one another via said first and second supports.

7. The spatial unit according to claim 6, further comprising at least one supporting strip for supporting an outer wall element and disposed on said lower longitudinal carrier.

8. The spatial unit according to claim 7, wherein said supporting strip has a shape of an elbow.

9. The spatial unit according to claim 7, further comprising connecting means, said outer wall elements are connected to said upper longitudinal carrier via said connecting means.

10. The spatial unit according to claim 7, wherein said connecting means is a screw connection.

11. The spatial unit according to claim 6, wherein said lower longitudinal carrier has an open cross section.

12. The spatial unit according to claim 11, further comprising a prefabricated floor element inserted into said open cross section of said lower longitudinal carrier.

13. The spatial unit according to claim 12, wherein said prefabricated floor element is self-supporting and substantially flexurally rigid.

14. The spatial unit according to claim 11, wherein said open cross section is U-shaped.

15. The spatial unit according to claim 1, wherein said outer wall elements have vapor barriers extending beyond end sides of said outer wall elements, said vapor barriers being connected to one another in a region of said recess of two adjacent said outer wall elements and sealing in a largely wind proof and vapor proof manner said interior of the spatial unit enclosed by said outer wall elements.

16. The spatial unit according to claim 15, further comprising a self-adhesive film disposed in a region of said recess, said self-adhesive film connects said vapor barriers of said outer wall elements to one another, and said vapor barriers extend beyond said end sides of said adjacent outer wall elements.

17. The spatial unit according to claim 1, further comprising supply lines disposed in said corner elements.

18. The spatial unit according to claim 1, wherein said corner elements can be adhesively bonded into said recesses.

19. The spatial unit according to claim 1, further comprising foundations mounted in a subsoil for supporting corner regions of the spatial unit.

20. The spatial unit according to claim 19, further comprising at least one leveling element for equalizing a height of said foundation and disposed on said foundation.

21. The spatial unit according to claim 1, wherein said lining is formed from a material selected from the group consisting of sheet metal, plastic and wood.

22. A building construction, comprising:

at least first and second spatial units connected releasably to one another, each of said spatial units including:

crossmembers having outer edges;

first and second rectangular, substantially closed longitudinal frames connected releasably to one another via said crossmembers and having outer edges, said longitudinal frames and said crossmembers forming a three-dimensional, self-supporting frame construction;

outer wall elements having outer edges and fastened releasably to said first and second longitudinal frames, said outer wall elements being substantially of a size corresponding to a height, a width or length of the spatial unit and terminate flushly at said outer edges with said outer edges of said longitudinal frames, said outer edges of said outer wall elements terminating flushly with said outer edges of said longitudinal frames and of said crossmembers;

a plurality of corner regions including bent-in corners defined by recesses formed by end sides of adjacent ones of said outer wall elements; and corner elements fastened releasably in said recesses, said corner elements seal an interior of the spatial unit delimited by said outer wall elements;

said spatial units disposed next to one another or above one another and also next to one another and above one another are connected releasably to one another for increasing or reducing the building construction, free outer sides of the building construction being enclosed substantially completely by said outer wall elements;

wherein said coupling elements have vapor barriers which extend beyond sides facing said end sides of said outer wall elements, said vapor barriers of said coupling elements being connected to vapor barriers of said outer wall elements and sealing in a largely wind proof and vapor proof manner said interior which is enclosed by said outer wall elements and said coupling elements.

23. The building construction according to claim 22, wherein said spatial units are disposed spaced apart from one another; and further comprising coupling elements fastened releasably between said end sides of said adjacent outer wall elements of said spatial units which are disposed spaced apart from one another.

24. The building construction according to claim 23, wherein a spacing between said spatial units which are disposed spaced apart from one another lies in a range from 20 cm to 50 cm.

25. The building construction according to claim 24, wherein said spacing is 30 cm.

26. The building construction according to claim 23, further comprising a floor element and a ceiling element being fastened releasably between said spatial units which adjoin one another in a spaced apart manner.

27. The building construction according to claim 22, further comprising a damping element disposed between said spatial units.

28. The building construction according to claim 27, wherein said damping element is made from neoprene.

29. The building construction according to claim 22, further comprising a sealing band disposed between adjacent ones of said outer wall elements which are disposed above one another or next to one another, for sealing joints which are disposed between said outer wall elements.

30. The building construction according to claim 29, wherein said sealing band is made from a material selected from the group consisting of a permanently elastic polyurethane foam plastic and EPDM which is impregnated with bitumen.

31. The building construction according to claim 22, further comprising a rear-ventilated facade disposed spaced apart and in front of said outer wall elements.

32. The building construction according to claim 22, further comprising non-supporting inner wall elements, said adjacent spatial units are separated by said non-supporting inner wall elements.

33. The building construction according to claim 32, wherein said non-supporting inner wall elements are lightweight partition walls.

* * * * *